United States Patent [19]

Russo

[11] Patent Number: 4,878,429

[45] Date of Patent: Nov. 7, 1989

[54] MAGNETIC ROTARY LOCKING MECHANISM AND METHOD

[75] Inventor: Alberto Russo, Buena Park, Calif.

[73] Assignee: Nu-Graphics Engineering, Inc., Huntington Beach, Calif.

[21] Appl. No.: 199,156

[22] Filed: May 26, 1988

[51] Int. Cl.[4] ..... B41F 27/00

[52] U.S. Cl. ..... 101/486; 101/389.1

[58] Field of Search ..... 101/415.1, 378, 382, 101/382 MV, 389.1, 486; 334/295, 288, 285; 242/147 M, 150 M, 155 M

[56] References Cited

U.S. PATENT DOCUMENTS

| | | | |
|---|---|---|---|
| 2,209,558 | 7/1940 | Bing et al. | 335/295 |
| 2,471,067 | 5/1949 | Hitchcock | 335/295 |
| 2,730,949 | 1/1956 | Mitchell | 101/382 MV |
| 3,017,545 | 1/1962 | Meier | 101/382 MV |
| 4,036,133 | 7/1977 | Kocsis et al. . | |
| 4,064,803 | 12/1977 | Czinger . | |
| 4,133,264 | 1/1979 | Fermi et al. . | |
| 4,154,167 | 5/1979 | Czinger . | |
| 4,191,106 | 3/1980 | Fermi et al. . | |
| 4,239,092 | 12/1980 | Janson | 188/267 |
| 4,332,197 | 6/1982 | Dulin . | |
| 4,402,265 | 9/1983 | Pickard . | |
| 4,482,849 | 11/1984 | Doeman et al. | 318/138 |
| 4,505,199 | 3/1985 | Hasegawa et al. | 101/382 MV |
| 4,587,900 | 5/1986 | Oshio | 101/382 MV |
| 4,652,845 | 3/1987 | Finkle | 335/295 |

FOREIGN PATENT DOCUMENTS

| | | | |
|---|---|---|---|
| 1866348 | 11/1955 | Austria | 101/415.1 |
| 3626243 | 2/1988 | Fed. Rep. of Germany | 101/415.1 |
| 756013 | 8/1956 | United Kingdom | 242/147 M |
| 928737 | 6/1963 | United Kingdom | 101/415.1 |
| 1512180 | 5/1978 | United Kingdom | 101/382 MV |

*Primary Examiner*—Eugene M. Eickholt

*Attorney, Agent, or Firm*—Knobbe, Martens, Olson & Bear

[57] ABSTRACT

A magnetic rotary locking mechanism for locking a plate or sheet-like member by placing it in tension which may be adapted to provide a self-tensioning locking device for securing a printing plate to a printing cylinder in a rotary printing press. The base and rotatable bar each have formed therein a plurality of magnetic strips which generate a plurality of magnetic fields so that the bar magnetic fields are attracted to the base magnetic fields at a first angular position of the bar with respect to the base and are repelled by the base magnetic fields at a second angular position of the bar with respect to the base.

13 Claims, 2 Drawing Sheets

MAGNETIC ROTARY LOCKING MECHANISM AND METHOD

BACKGROUND OF THE INVENTION

The present invention relates generally to a rotating locking or positioning mechanism and method for locking or positioning a plate or sheet-like member by placing it in tension. More particularly, the present invention relates to a self-tensioning device for securing a printing plate to a printing cylinder in a rotary printing press.

It is common practice in the printing industry to use flexible metallic plastic or paper printing plates having a raised or planographic image on one side thereof attached to a printing cylinder in a rotary printing press. The raised image on the printing plate is transferred to the paper as the printing cylinder rotates and the paper is moved through the rotary printing press.

Printing plates are typically changed relatively often whenever a different image is desired. Because the rotary printing press must be shut down in order to change printing plates, printing plates must be easily changeable so as to reduce costly downtime.

As explained in U.S. Pat. No. 4,332,197 to Dulin, efforts to devise low cost printing plates have resulted in printing plates which are dimensionally unstable when exposed to different humidity and temperature levels. The resulting variation in printing plate dimensions creates a need for a self-tensioning printing plate locking mechanism to maintain tension on the printing plate to closely fit the periphery of the press cylinder.

Because the press operator must change the printing plates frequently, it is important that the locking mechanism be simple to operate. Moreover, the operators must work in very close spaces with great possibility of injury to the operator or marring the printing due to excessive handling. Thus, simplicity of the operation of a locking mechanism for rotary printing presses is paramount.

Because printing plate locking mechanisms are often difficult to access for repair, it is important that they require infrequent repair to minimize expensive downtime. Thus, it is desirable to construct such a mechanism with as few moving parts as possible so as to minimize breakdowns.

A number of printing plate locking mechanisms are found in the art. These mechanisms are relatively complicated mechanically and expensive to build and maintain.

Thus, there has been a need in the field of printing plate locking devices for such a device which is easily operated, inexpensive to construct and maintain, and which provides constant tension on printing plates of varying lengths.

SUMMARY OF THE INVENTION

The present invention is a rotating locking mechanism for locking a plate or sheet-like member by placing it in tension. The present invention is a mechanism having a first member and a second member rotatable with respect thereto, one member having means to attach to an object to be positioned or locked, and both members having means for magnetically urging rotation therebetween. The present invention also contemplates a method of applying tension to an object by securing the object to a rotatably mounted member and magnetically urging that member to rotate.

In one embodiment, the present invention comprises a first member having a first magnetic field provided therein, and a second member having means for securing the object to be locked and having a second magnetic field provided therein, which is of the same polarity as the first magnetic field. The mutual repulsion of the like first and second magnetic fields urges relative rotation between the first and second members, which are arranged to rotate with respect to each other. When the first and second members are arranged so that the first and second magnetic fields are proximate, the repulsion force is relatively large. When members are arranged so that the magnetic fields are not proximate, the repulsion force is relatively small. Thus, after aligning the magnetic fields so they are adjacent, release of the members allows relative rotation therebetween so that the means for securing the object to be locked is rotationally displaced. This rotational displacement acts to lock the object in tension.

In an alternate embodiment, either member may have, instead of its associated magnetic field of like polarity to the magnetic field of the other, an element that is magnetically conductive or that has a magnetic field of opposite polarity such that the element is attracted by the magnetic field of the other member. The object may be attached to the second member while the second member is in a rotational orientation with respect to the first member such that the magnetic attraction urges relative rotation therebetween so that the means for securing the object to the locked is rotationally displaced. This rotational displacement acts to lock the object in tension.

In an alternate embodiment, either or both members may be provided with a plurality of discrete magnetic fields proximate the other member, the respective magnetic fields of each member occupying a spaced relation. To engage the object to be locked with the second member, the operator rotates the second member with respect to the first member so that the second magnetic fields are brought closer to the first magnetic fields of like polarity, thereby increasing the magnetic repulsion acting to resist such rotation of the respective members. Once the object is engaged, the operator releases the second member, thereby allowing it to rotate away from the aligned position, urged by the magnetic repulsion into a locking relation. This magnetic repulsion is augmented by magnetic attraction between magnetic fields of unlike polarity.

The present invention is advantageously employed in conjunction with a rotary printing cylinder for locking thereon a printing plate. In one embodiment, the printing cylinder has attached thereto a base provided with a plurality of magnetic fields therein and a bar rotatably received by the base, which also has a plurality of magnetic fields arranged therein. The bar and base magnetic fields are arranged so that the bar magnetic fields are attracted to the base magnetic fields at a first angular position of the bar with respect to the base and are repelled by the base magnetic fields at a second angular position of the bar with respect to the base. The bar has provided therein a groove at other means for securing the end of an object to be locked. The operator rotates the bar toward the position at which the magnetic fields of like polarity are aligned and inserts the free end of the printing plate in the groove of the bar. The operator then releases the bar, which is rotatably urged toward the position at which the bar magnetic fields are attracted to the base magnetic fields. The magnetically-induced rotational force locks the printing plate snugly against the outer surface of the printing cylinder.

In a particularly preferred embodiment of the present invention, the magnetic fields are provided by a plurality of spaced, parallel, magnetiferous strips oriented parallel to the axis of rotation of the bar. The base and bar contain three conductive strips, with a magnet between the first and second strips of both the base and bar and with another magnet between the second and third strips of both the base and bar. This arrangement provides first and third conductive strips having a first polarity and a central, second conductive strip having a second polarity. When aligned in a parallel relation, this arrangement causes the magnetic fields of the strips to repel, thereby urging the bar to rotate away from this aligned position. Urging the bar in a rotational direction away from the aligned position causes the attached printing plate or other object to be placed in tension, thereby locking it.

DETAILED DESCRIPTION OF THE PREFERRED EMBODIMENT

Figure 1:
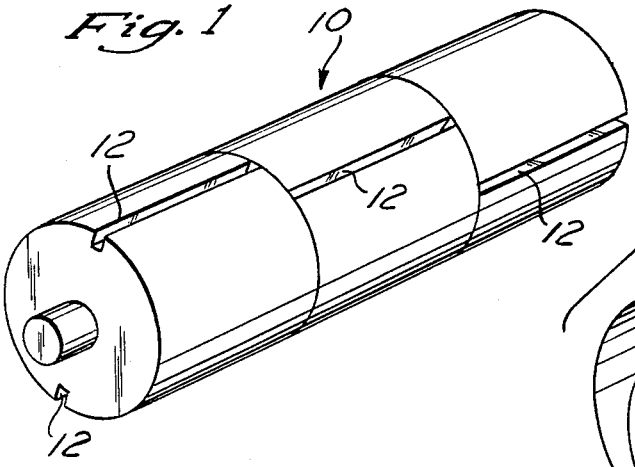
FIG. 1 is a perspective view of a printing cylinder for a rotary printing press.

FIG. 1 shows a printing cylinder 10 such as is commonly used with rotary printing presses. Located on the periphery of cylinder 10 are grooves 12. As shown, a printing cylinder may be made in sections so that the grooves 12 are not aligned.

Figure 2:
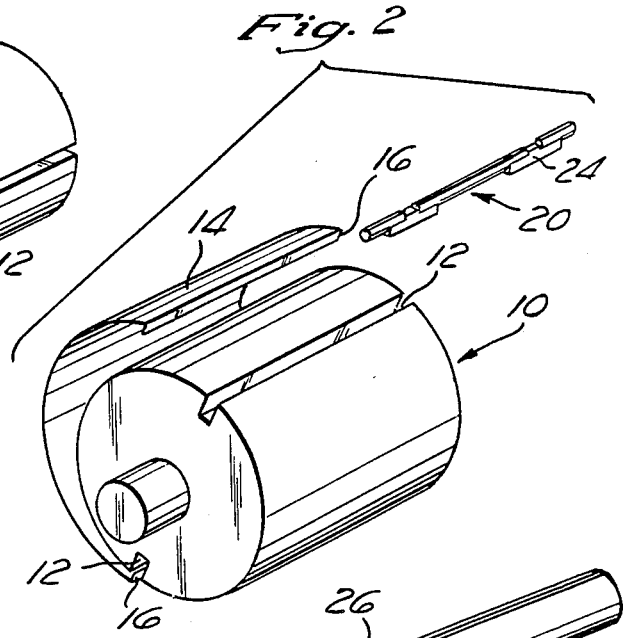
FIG. 2 is an exploded perspective view of a printing cylinder, printing plate, and the magnetic rotary lock bar of the present invention.

As shown in FIG. 2, mounted on the periphery of printing cylinder 10 is printing plate 14. Each end of printing plate 14 is formed into a hook 16. One hook 16 may be conveniently registered in the groove 12 as shown in the bottom of FIG. 2. The other end of printing plate 14 is secured and printing plate 14 is tightly wrapped around the periphery of printing cylinder 10 by means of magnetic rotary locking mechanism assembly 20.

Figure 3:
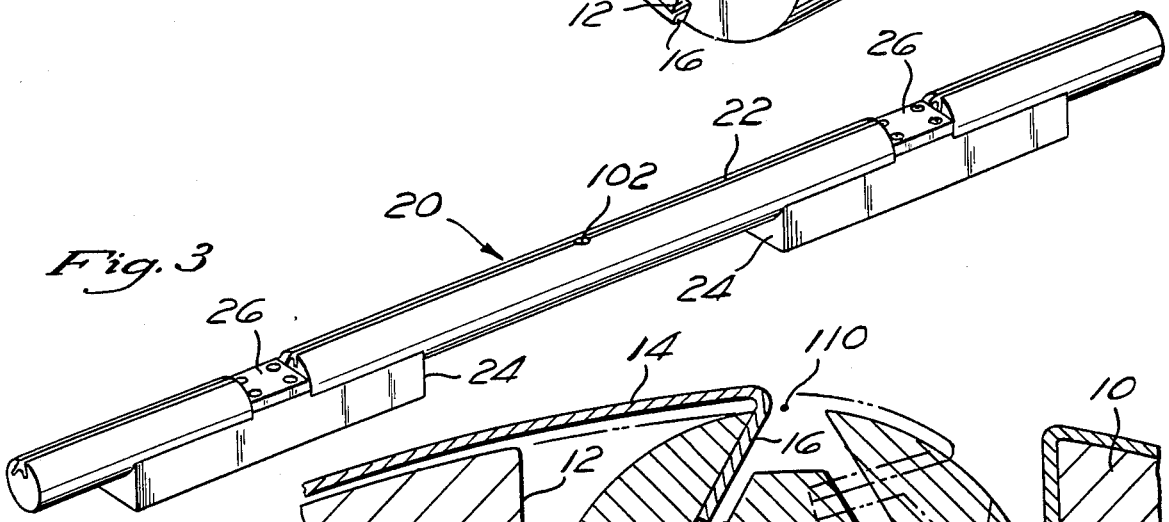
FIG. 3 is a perspective view of a preferred embodiment of the magnetic rotary locking mechanism of the present invention.

As shown in FIG. 3, magnetic rotary locking mechanism assembly 20 comprises bar 22, base members 24, and retaining members 26.

Figure 5:
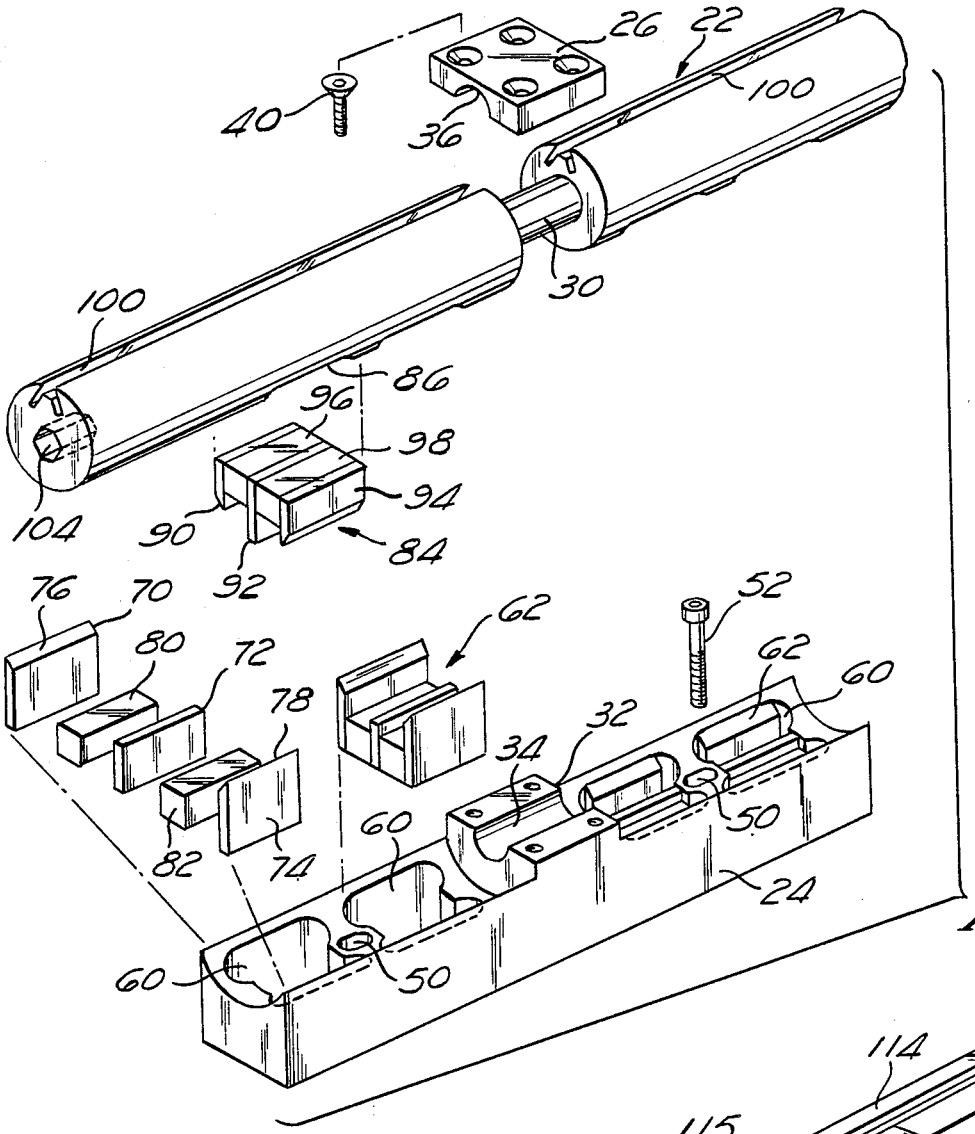
FIG. 5 is a partial exploded perspective view of the assembly of FIG. 3.

Referring the FIG. 5, bar 22 is generally cylindrical, and may be provided with neck portion 30 of reduced diameter. A collar 32 of reduced diameter is provided on base 24. The interior surface 34 is sized to rotatably receive bar neck portion 30 therein. Bar 22 may be rotatably secured to base member 24 by means of retaining member 26, which also has an interior surface 36 sized to rotatably receive bar neck portion 30. Retaining member 26 may be conveniently affixed to base collar 32, for example, by means of retaining screws 40. Retaining member interior surface 36 and base collar interior surface 34 may advantageously form with bar neck portion 30 a fairly tight running fit. The remainder of bar 22 preferably forms with the base member 24 a relatively loose running fit so as to provide clearance therebetween. This clearance facilitates rotation of the bar 22 and prevents binding caused by the magnetic attraction between bar 22 and base 24. It will be readily apparent to those of skill in the art that the present invention is not limited to use with this type of rotational coupling. For example, this invention may be used advantageously with bearings of many kinds.

Base member 24 has provided therethrough mounting holes 50 for acceptance of mounting screws 52, which are used to affix base member 24 to printing cylinder 10. Base mounting screws 52 are shown as socket head cap screws, but any suitable form of registering and locking mechanism may be utilized.

Base member 24 is provided with recesses 60 for receiving magnet assembly 62. Magnet assembly 62 is composed of magnetiferous strips 70, 72, and 74. First magnetiferous strip 70 may be conveniently provided with a beveled top edge 76 to increase the surface area closely proximate bar 22. Likewise, the top edge 78 of third magnetiferous strip 74 is beveled in the direction opposite that of beveled top edge 76 of first magnetiferous strip 70.

First, second and third base magnetiferous strips 70, 72 and 74 may be magnets. However, the inventor has found it more convenient to form these base magnetiferous strips of material that conducts magnetism and place between these strips two magnets 80, 82. This arrangement allows use of standard-sized magnet materials and obviates the need to machine a bevel into the magnetic material, which may substantially decrease or eliminate the magnetic property of the magnet.

Bar magnet assembly 84 may be conveniently formed identical to base magnet assembly 62. Bar magnet assembly 84 is received by bar magnet recess 86, which may conveniently be formed in the same fashion as base magnet recess 60.

Bar magnet assembly 84 comprises first, second, and third magnetiferous strips 90, 92, and 94. First and third magnetiferous strips 90, 94 may be conveniently provided with a beveled bottom edge to increase the surface area closely proximate the corresponding base magnetiferous strips 70, 74. As in the base magnet assembly 62, first, second, and third bar magnetiferous strips 90, 92, and 94 may be magnets. However, the inventor has found it more convenient to form these bar magnetiferous strips of material that conducts magnetism and place between these strips two bar magnets 96, 98 for the same reason advanced above regarding the base magnet assembly 62.

Figure 4:
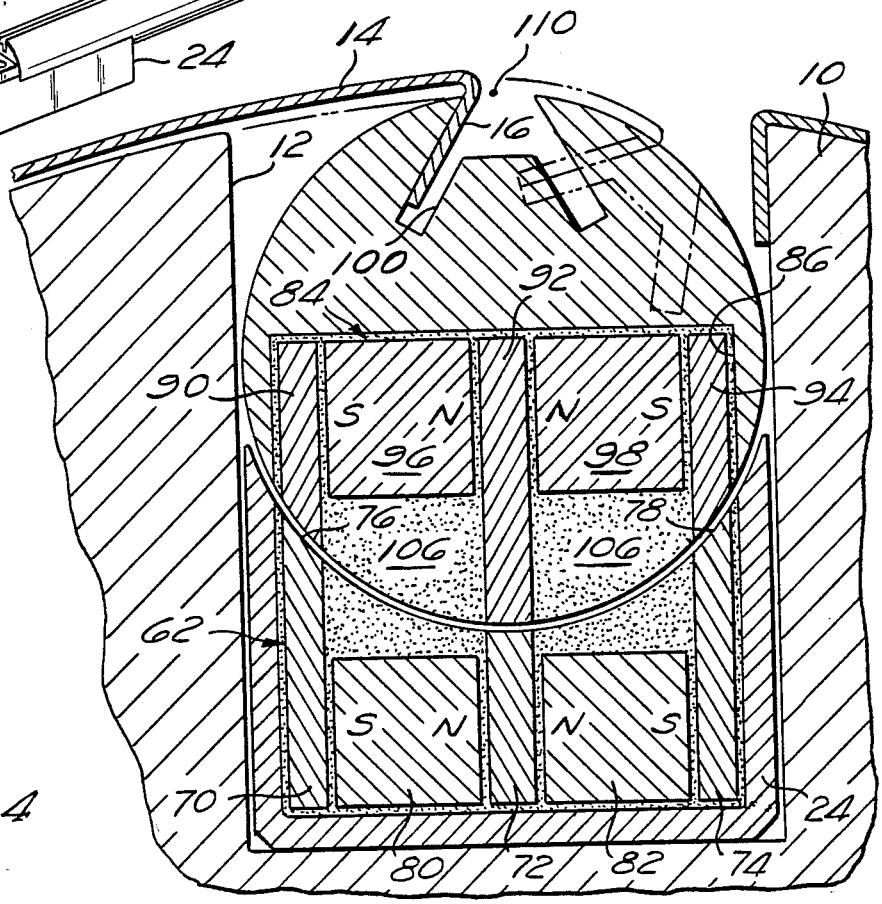
FIG. 4 is a cross-sectional detail of the locking mechanism, printing plate, and printing cylinder.

Bar 22 has formed in the top thereof printing plate receiving slot 100, which is shown in the form of an inverted V-shape. The free end or hook 16 of printing plate 14 may be hooked over the edge of printing plate receiving slot 100 as shown in FIG. 4. Rotation of bar 22 in a clockwise direction causes printing plate 14 to be pulled in tension and tightly wrapped around the periphery of printing cylinder 10.

In order to rotate the bar 22 to a position where printing plate hook 16 may be engaged in printing plate receiving slot 100, the operator rotates bar 22 toward the position shown in FIG. 4 by means of a tool placed in either central manipulation hole 102 or end manipulation hole 104. Grooves 12 in printing cylinder 10 may be arranged so as to preclude access from the ends thereof, as shown in FIG. 1. In such case, the operator would have to use central manipulation hole 102. The operator rotates the bar 22 from its rest position, which may be clockwise or counterclockwise from the position shown in FIG. 4, until receiving slot 100 accepts printing plate hook 16. The position of bar 22 when aligned to accept hook 16 depends on the particular configuration of slot 100 and hook 16.

A particularly preferred embodiment of the present invention is shown in FIG. 4. Base member 24 is shown fixed to the bottom of printing cylinder groove 12. Arranged within base member 24 in spaced parallel relation are first, second and third base magnetiferous strips 70, 72 and 74. Disposed between first and second base magnetiferous strips 70, 72 is first base magnet 80. Disposed between second and third base magnetiferous strips 72, 74 is second base magnet 82. The corresponding poles of first and second base magnets 80, 82, shown marked N in FIG. 4, are placed adjacent the common magnetiferous strip 72. The magnetic field of the polarity N is induced into second base magnetiferous strip 72. Likewise, the proximity between first and third base magnetiferous strips 70, 74 and first and second base magnets 80, 82 result in a magnetic field of the polarity S being induced in first and third magnetiferous strips 70, 74.

The first, second, and third magnetiferous strips 70, 72, 74 and first and second base magnets 80, 82 may be conveniently affixed in base member 24 by means of epoxy resin 106. One skilled in the art will appreciate that a number of suitable means may be used to secure the strips and magnets into the base member 24.

Within bar magnet recess 86 are disposed first, second, and third bar magnetiferous strips 90, 92, 94 and first and second bar magnets 96 and 98. As with the base magnet assembly 62, bar magnet assembly 84 may be secured within bar magnet recess 86 by any suitable means, including epoxy resin 106 as shown. Similar to base magnet assembly 62, bar magnet assembly 84 is arranged so that the polarities N of first and second magnets 96, 98 are adjacent to second bar magnetiferous strip 92. Thus, first and second magnets 96, 98 induce a magnetic field of polarity N into second bar magnetiferous strip 92. On the other hand, the polarities S of first and second bar magnets 96, 98 are placed adjacent first and third bar magnetiferous strips 90, 94, respectively. Accordingly, first and third bar magnetiferous strips 90, 94 have induced therein a magnetic field of polarity S.

In the position shown in FIG. 4, bar 22 is in a metastable position. That is, any rotational force will cause bar 22 to rotate as repelled by the magnetic fields of like polarity of first base magnetiferous strips 70 and first bar magnetiferous strips 90, second base magnetiferous strip 72 and second base magnetiferous strip 92, and third base magnetiferous strip 74 and third bar magnetiferous strip 94. For example, if the operator has placed the printing plate hook 16 into printing plate receiving slot 100 as shown in FIG. 4, he can then urge the magnetic rotary lock bar 20 into the locked position, as shown in phantom, by urging the bar in a clockwise direction. The operator may urge the bar in a clockwise position by inserting a tool into central manipulation hole 102 or in end manipulation hole 104. Once the bar 22 is rotationally disposed in a clockwise direction from the position shown in FIG. 4, the magnetic field of polarity S of third bar magnetiferous strip 94 is repelled from that of third base magnetiferous strip 74 toward the magnetic field of polarity N of second base magnetiferous strip 72. Similarly, the magnetic field of polarity N of second bar magnetiferous strip 92 is repelled from the same of second base magnetiferous strip 72 and toward the magnetic field of polarity S of first base magnetiferous strip 70. The magnetic field of polarity S of first bar magnetiferous 90 is repelled by that of first base magnetiferous 70. The respective attraction and repulsion of the magnetic fields of opposite and like polarity urges bar 22 in the clockwise direction, which places printing plate 14 in tension and snugly wraps it around the outer periphery of printing cylinder 10. After locking the printing plate 14 in place with the magnetic rotary lock bar 20, the operator removes the tool from the central or end manipulation hole 102, 104. Another printing plate 14 may be hooked against the exposed side of groove 12 and locked by means of another magnetic rotary lock bar fixed in a groove 12 on the opposite side of the printing cylinder 10.

In order to remove the printing plate 14 from its locked relationship with the printing cylinder 10, the operator simply places a tool into the central or end manipulation holes 102, 104 and rotates bar 22 in the counterclockwise direction until it reaches the configuration shown in FIG. 4. Upon passing through that metastable position, the magnetic field of polarity S of third bar magnetiferous strip 94 will be repelled by that of third base magnetiferous strip 74. Likewise, the magnetic field of polarity N of second bar magnetiferous strip 92 will be repelled by that of second base magnetiferous strip 72 and attracted by the magnetic field of polarity S of third base magnetiferous strip 74. Finally, the magnetic field of polarity S of first bar magnetiferous strip 90 will be repelled by that of first base magnetiferous strip 70 and attracted by the magnetic field of polarity N of second base magnetiferous strip 72. These magnetic attractions and repulsions will urge bar 22 in a counterclockwise direction once bar 22 is rotated beyond the metastable position of FIG. 4, thereby freeing printing plate hook 16 from printing plate receiving slot 100 and allowing removal of printing plate 14 from printing cylinder 10.

Figure 6:
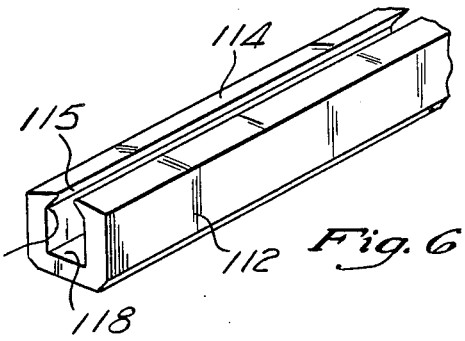
FIG. 6 is a perspective view of a portion of an insert which may be used with the present invention.
Figure 7:
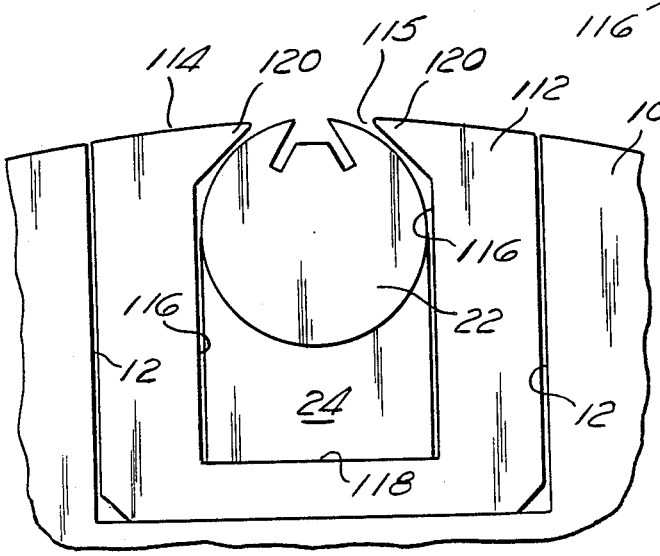
FIG. 7 is a cross-sectional view of the present invention utilized with the insert of FIG. 6.

Referring to FIG. 4, the distance between the side of groove 12 and the apex 110 of the outer periphery of bar 22 defines an area of printing plate 14 which is radially unsupported. The absence of support from this section of printing plate 14 precludes application of pressure sufficient to cause transfer of a printed image. The unprinted space due to this gap, however, may be reduced by use of an insert 112 as shown in FIGS. 6 and 7. Insert 112 is a generally rectangular bar having a convex top surface 114 of a radius substantially equal to that of the outer surface of printing cylinder 10. Insert top surface 114 has provided therein recess 115 formed by insert sidewalls 116, insert recess bottom 118, and insert shelf 120. The top surface 114 of insert 112 is extended over bar 22 so that shelves 120 project inward from insert sidewalls 116 and provide additional support and increase the effective area of the printing cylinder 10. Use of insert 112 substantially reduces the amount of unprinted space. For example, where the locking assembly is approximately $\frac{3}{4}''$ wide, the unprinted space without the insert will be slightly greater than $\frac{3}{4}''$. Using an insert with shelves 120 undercut at a 30° angle, the unprinted space is reduced to less than $\frac{1}{2}''$. Use of sharper angles will provide a smaller unprinted width. However, sharper angles also reduce the amount of support imparted to the shelves 120 and make such shelves relatively fragile. The inventor has found shelves undercut to an angle of 30° to be relatively rugged and to provide suitable support for printing purposes.

Insert 112 may be conveniently mounted to printing cylinder groove 12 by many suitable means, including screws. Base member 24 and bar 22 may be slid endwise into insert 112 and affixed by many suitable means, including screws.

This invention has been described in detail in connection with the preferred embodiments, but these are examples only and this invention is not restricted thereto. It will be easily understood by those skilled in the art that other variations and modifications can be easily made. For example, the polarities of magnets 80, 82, 96, 98 could be reversed. Moreover, the present invention is not limited to use of six magnetiferous strips, but could be employed, for example, with four—either two magnets or one magnet plus two conductive strips in each member. It will also be easily understood that a similar effect may be achieved by using a single magnetic field in one member and a magnetic field of like polarity in the other member. Further, the polarities of magnets 80, 82 only could be reversed, causing the mechanism to be drawn to the position shown in FIG. 4. Similarly, a single magnet could be used in one member and a conductive strip or magnet of unlike polarity could be used in the other. It will also be easily understood by those skilled in the art that this invention may be applied to applications other than rotary printing presses.

What is claimed is:

1. The method of applying tension to an object comprising the steps of:

securing a restrained object to a rotatably mounted member; and magnetically urging said member to rotate in a direction such that said urging applies tension to said object, wherein said object is a printing plate wrapped onto the periphery of the cylinder in a rotary printing press, and said member is a bar mounted in a groove in the periphery of the cylinder, and wherein said securing step includes attaching a free end to said plate to said bar and including the step of releasing said bar after said securing step to allow said bar to be magnetically rotated in said direction to apply tension to said plate, thereby locking the plate into position.

2. The method of claim 1, including the steps of:

rotating said member to a metastable position for said securing step; and rotating said member away from said metastable position to allow the member to be magnetically urged in said direction.

3. The method of claim 1, including the step of:

rotating said member to a position where said securing step can be performed.

4. The method of claim 1, wherein said urging step includes maintaining said member spaced from means providing said urging.

5. A mechanism for applying tension to a printing plate wrapped onto a cylinder, comprising:

means for securing a first end of said printing plate, said securing means being rotatably mounted on the periphery of said cylinder; and magnetic means for magnetically urging said securing means to rotate in a direction to apply tension to said plate.

6. The mechanism of claim 5, wherein said magnetic means includes a magnetiferous element mounted on said securing means and a magnetiferous element adjacent said securing means fixed with respect to said cylinder.

7. The mechanism of claim 5, including a base fixed to a groove in the exterior of said cylinder, and means for rotatably mounting said securing means on said base, said magnetic means including magnetic elements on said securing means and said base which cooperate to urge said securing means to rotate in said tensioning direction.

8. A mechanism for applying tension to a printing plate wrapped onto a cylinder, comprising:

a base fixed to a groove in the exterior of said cylinder, wherein said base is an elongated member having a concave upper surface;

a bar rotatably mounted on said cylinder, said bar being adapted to be attached to said plate, wherein said bar is an elongated member having a cylindrical exterior surface which moves in close proximity to said base surface when said bar is rotated; and magnetic means for magnetically urging said bar to rotate in a direction to apply tension to said plate, said magnetic means including magnetic elements on said bar and said base which cooperate to urge said bar to rotate in said tensioning direction, wherein said magnetic elements are embedded in said surfaces.

9. The mechanism of claim 8, wherein said bar includes an elongated slot opening to its exterior surface for receiving a hook on one end of said plate.

10. A mechanism for applying tension to a printing plate wrapped onto a cylinder, comprising:

means for securing an end of said printing plate, said securing means being rotatably mounted on the periphery of the cylinder; and magnetic means for urging rotation of said securing means so that said printing plate is wrapped taut about said cylinder, said urging providing tensioning of said printing plate.

11. The mechanism of claim 10, wherein said securing means includes a cylindrical rod, and said magnetic means includes magnetic elements disposed within the confines of said cylindrical rod.

12. A mechanism for applying tension to a printing plate wrapped onto a cylinder, comprising:

a member rotatably mounted on the periphery of said cylinder to move in closely spaced relation to structure mounted on the cylinder, said bar being adapted to be attached to said plate; and said member and said structure including magnetic means for magnetically urging said member to rotate in a direction to apply tension to said plate while maintaining said member in closely spaced relation relative to said structure.

13. A rotary locking mechanism for securing a printing plate to a cylinder in a rotary printing press, said cylinder having a groove with a groove bottom formed in the outer periphery thereof, and said printing plate having a hook formed on an end thereof, comprising:

a base secured to said printing cylinder within said groove having a magnet providing a base magnetic field of a first polarity distal said groove bottom; and a bar rotatable with respect to said base disposed within said groove having a magnet providing a bar magnetic field of said first polarity, said bar having an aperture therein for receiving said printing plate hook so that said base magnetic field repels said bar magnetic field and causes rotation of said bar such that said printing plate is pulled taut about the periphery of said cylinder.

* * * * *